United States Patent [19]

Ahrens

[11] 3,971,076

[45] July 27, 1976

[54] POOL FOR TEACHING SWIMMING TO A CHILD

[76] Inventor: Claude W. Ahrens, Box 275, Grinnell, Iowa 50112

[22] Filed: Nov. 25, 1974

[21] Appl. No.: 526,492

Related U.S. Application Data

[62] Division of Ser. No. 422,349, Dec. 6, 1973, abandoned.

[52] U.S. Cl. ..... 4/172.19

[51] Int. Cl.[2] ..... E04H 3/16; E04H 3/18; F16L 4/02

[58] Field of Search ..... 4/172, 172.19

[56] References Cited

UNITED STATES PATENTS

| | | | |
|---|---|---|---|
| 2,490,272 | 12/1949 | Kascle | 4/172.19 |
| 3,427,662 | 2/1969 | Jacuzzi et al. | 4/172.19 |
| 3,443,263 | 5/1969 | Minasy | 4/172.19 |

*Primary Examiner*—Houston S. Bell, Jr.
*Attorney, Agent, or Firm*—Rudolph L. Lowell

[57] ABSTRACT

The pool is of an elongated trough shape and formed of connectible units or modules each of which has cross sectional dimensions providing for its passage through usual size school doors. The water is of a uniform depth over the full length of the pool such that a child may finger tip the bottom anywhere in the pool and is continuously heated, filtered and circulated. The bottom of the pool is marked with numbered training stations with a swimmer in a training station being addressed by the station number. Instructions may be given from within the pool or from a horizontal walkway extended outwardly from the upper edge of the pool.

1 Claim, 14 Drawing Figures

POOL FOR TEACHING SWIMMING TO A CHILD

This is a division of application Ser. No. 422,349, filed 12-6-73, now abandoned.

SUMMARY OF THE INVENTION

The pool is of a construction providing for the complete safety of a child and of a size to overcome a beginning swimmer's fear of a large expanse of water. The limited water expanse gives a child a feeling of security while providing adequate room for swimming movements and travel. The water depth in the tank is uniform and is readily variable to accommodate an elementary class requiring arm support on the pool bottom, or a more advanced class requiring arm clearance with the pool bottom but foot-touching with the pool bottom at all times. The controlled water depth, proximity of the instructor to all children in the pool and the maintaining of instruction control by a numbers system provides for a full enjoyment of the pool, and a willingness to learn swimming due to the absence of fear of the water. The pool is of an all fiberglass construction and relatively light in weight to permit its transport into schools or the like which lack pool facilities but which have a gym or auditorium in which the pool can be readily set up for use with its bottom wall supported directly on a floor surface.

DETAILED DESCRIPTION OF THE INVENTION

Figures 1, 2, 12, 13:
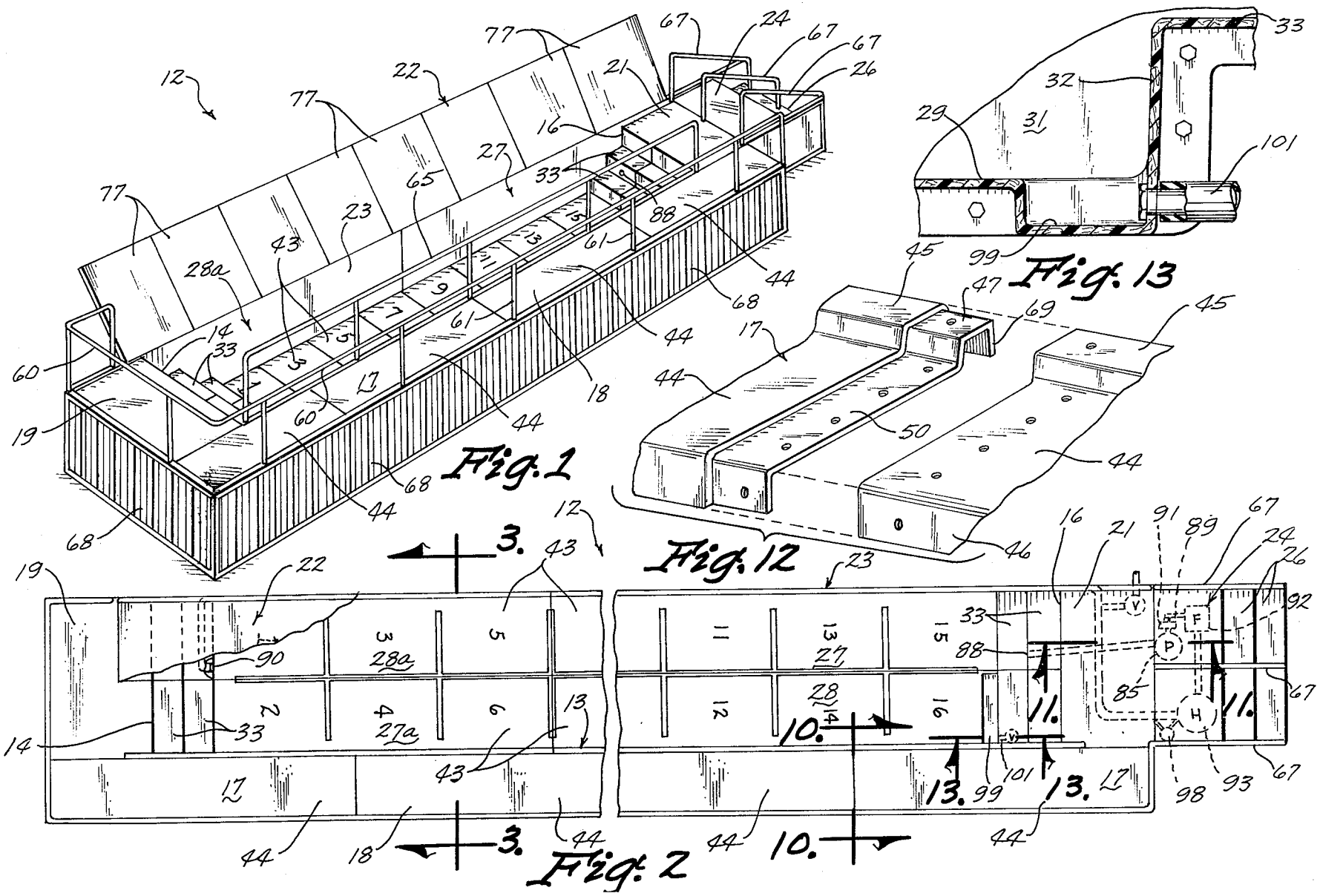
FIG. 1 is a front perspective view of the swimming pool of this invention.
FIG. 2 is an enlarged plan view of the pool shown in FIG. 1.
FIG. 12 is a detail exploded perspective view showing the adjacent connectible ends of plate members which form part of a walkway for the pool.
FIG. 13 is an enlarged sectional detail view as seen on line 13—13 of FIG. 2.
Figure 3:
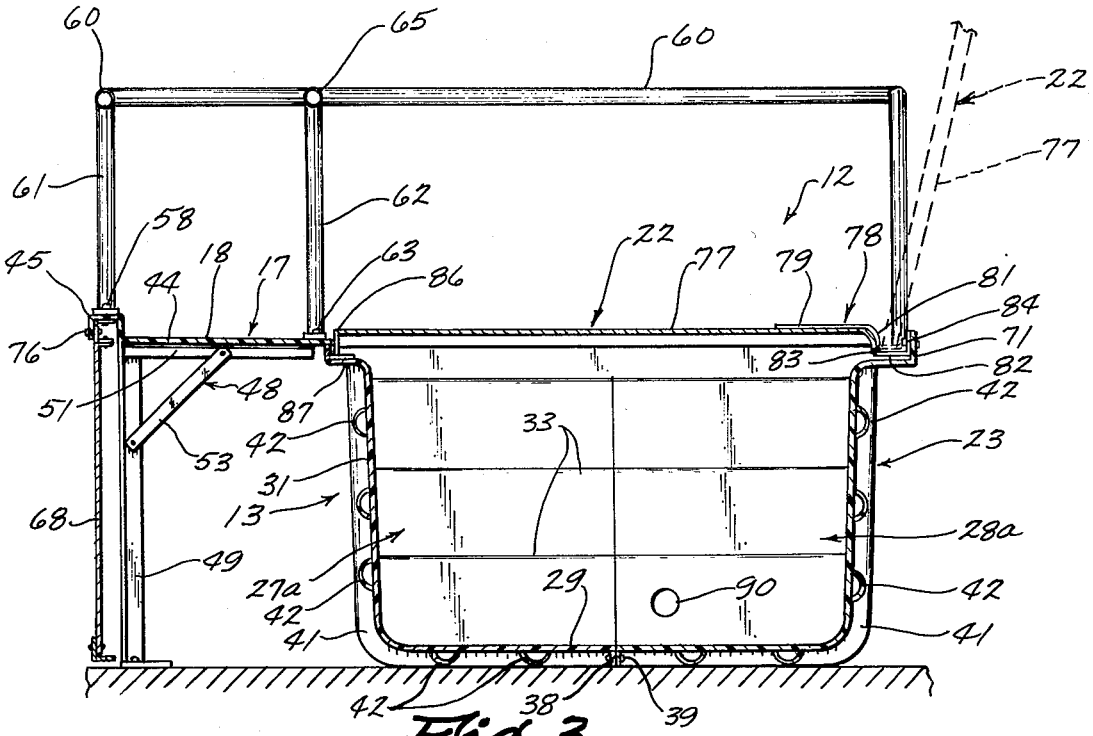
FIG. 3 is an enlarged transverse sectional view on line 3—3 in FIG. 2.

Referring to FIGS. 1 and 3, the pool of this invention is shown as including an elongated tank 12 of a generally trough shape. Extended laterally outwardly from the upper edge of the tank side wall 13 and both end walls 14 and 16 is a continuous walkway 17 which includes a longitudinal section 18 and transverse end sections 19 and 21. A sectional combination splash board and tank cover assembly 22 is hinged to the opposite side wall 23 of the tank for movement from a tank covering position shown in full lines in FIG. 3 to an upright position shown in FIG. 1 to function as a splash board. A machinery containing housing 24 is located adjacent the walkway end section 21 and is integrally formed with step members 26 for access to the walkway 17 from a floor or ground surface on which the tank is supported.

Figure 4:
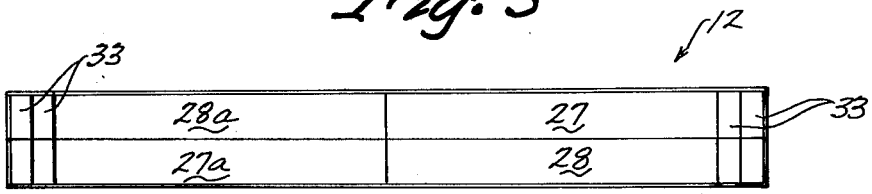
FIG. 4 is a diagrammatic plan view showing the modular assembly of the pool of FIG. 1.
Figure 5:
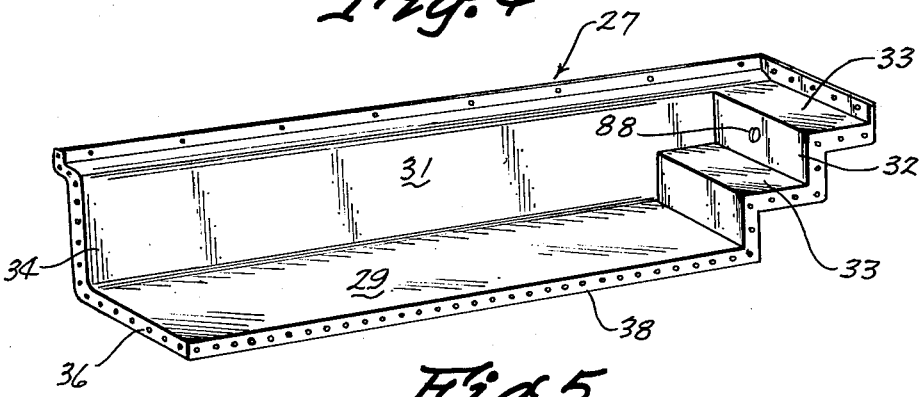
FIG. 5 is a perspective view of a module quarter section embodied in the pool, illustrated in FIGS. 1 and 4.

The tank is of a fiberglass modular construction and is illustrated in FIGS. 1, 2 and 4 as being composed of four quarter modules or sections 27, 27*a* and 28, 28*a*, which will be hereinafter referred to as right and left hand modules, respectively. The right hand module 27 (FIG. 5) is integrally formed with a bottom wall 29, a side wall 31 and an end wall 32 that is comprised of a series of step members 33. The open end 34 of the module section 27 terminates in an outwardly extended lateral flange 36 and the open side thereof in a lateral flange 38 that is continuous with the end flange 36.

A left hand quarter section or module 28 (FIGS. 2 and 4) is a mirror image of a right hand module 27 so that when a left hand module and a right hand module are positioned in a side by side relation the adjacent side flanges 38 thereof (FIG. 3) are connectible together by bolt assemblies 39. A left hand module and a right hand module thus together form one half of the tank 12 which is then completed by the assembly therewith of a corresponding one-half tank assembly comprised of a right hand module 27*a* and a left hand module 28*a*. These half tank assemblies are connected together at the end flanges 36. As best shown in FIGS. 1 and 4, it is seen that the right hand modules 27, 27*a* and left hand modules 28, 28*a* are disposed diagonally of the tank 12.

To reinforce the fiberglass walls of the modules 27, 27*a* and 28, 28*a*, the outer surface of the side wall 31 and bottom wall 29 of each module section is provided with longitudinally spaced brace members 41 of a generally right angle shape and formed of a metal pipe material (FIG. 3). These metal brace members 41 are interconnected with longitudinally extended brace members 42 comprised of half sections of cardboard or like composition tubes. The metal brace members 41 and half tube members 42 are rigidly secured to a side wall and a bottom wall by a fiberglass coating or sheet so as to form an integral part of a module. It is to be noted that the brace members 41 and 42 project a distance from the side wall and bottom wall of a module which is substantially equal to the width of an end flange 36 and side flange 38. The tank 12 is thus floor supported on those portions of the flanges 36 and 38 that project downwardly from the bottom wall 29 of a module as best appears in FIG. 3.

For a purpose to appear later, the bottom wall assembly of the tank 12 is marked off in a plurality of designated areas or training stations 43. These stations are arranged in a pair of side by side rows extended longitudinally of the tank, illustrated in FIGS. 1 and 2 as 16 in number and indicated by the numerals 1–16, inclusive.

Each end section 21 of the walkway 17 is comprised of a single plate member of a fiberglass construction. The longitudinal section 18 of the walkway 17 is formed of a plurality of plate members 44, illustrated as four in number in FIGS. 1 and 2, arranged end to end and having the adjacent ends thereof in an overlapped relation. Each side plate member 44 (FIG. 12), in transverse cross section, has an inverted U-shape portion 45 along the outer side thereof and a depending flange 46 at its inner or pool side. One end 50 of a side plate member 44 is of a reduced size in transverse cross section, as indicated at 47 in FIG. 12, relative to the opposite end 50 thereof so that the ends of adjacent side plate members 44 are constructed for assembly in an overlapped nested relation to form a smooth and continuous connection or junction between the plate members 44.

Figure 10:
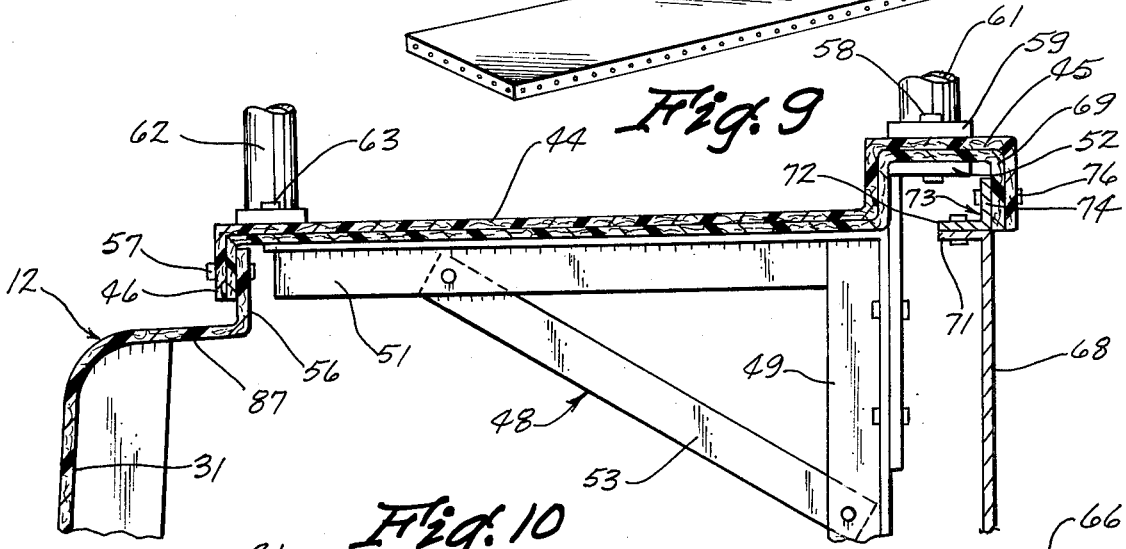
FIGS. 10 and 11 are enlarged detail sectional views taken on lines 10—10 and 11—11, respectively, in FIG. 2.
Figure 11:
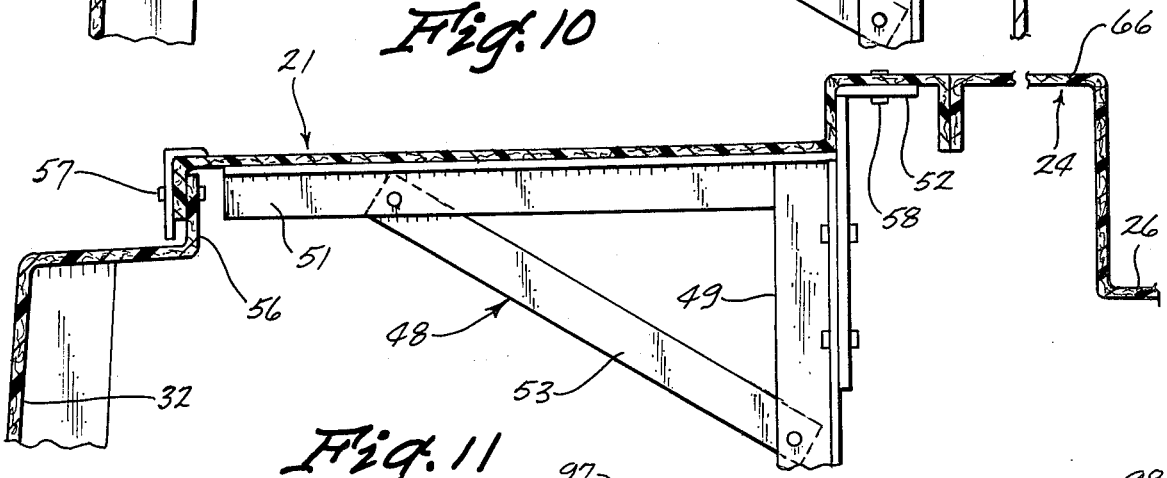

The walkway 17 is supported at each junction of adjacent side plate members 44, and the junction of an outermost plate member 44 with an adjacent walkway section 19 and 21 by a floor carried upright bracket assembly 48 (FIGS. 10 and 11). Each bracket assembly includes a leg member 49 and an arm member 51 projected laterally from the upper end of the leg member and interconnected therewith by a brace member 53. Secured to the leg member and spaced upwardly from the arm member 51 is a horizontal support 52.

The horizontal support member 52 (FIG. 10) is positioned within the U-shape portion 45 at the outer side of a plate member 44 in contact engagement with the base section of such U-shape portion. The depending flange 46 on the inner side of a plate member 44 is positioned in a side by side relation against the inner surface of an upright marginal flange 56 which defines the upper terminal ends of the side wall 31 and end wall 32 of the module sections 27, 27*a* and 28, 28*a*. The marginal flange 56 and side plate member flange 46 are secured together by bolt assemblies 57. A horizontal support member 52 and the overlapped ends of adjacent side plate members 44 are secured together by bolt assemblies 58.

These bolt assemblies 58 (FIG. 10) also secure to the outer side of the walkway 17 the base portions 59 of upright posts 61 which form part of an outer guard rail assembly 60 that extends about the outer side of the walkway 17. An inner upright guard rail 65 which extends only along the inner side of the walkway longitudinal section 18 has the legs or posts 62 thereof secured to the walkway by bolt assemblies 63. It is desirable that the walkway 17 be horizontally sloped downardly and inwardly from the outer side to the inner or pool side thereof for water draining purposes.

It is seen, therefore, that the pool 12 is provided at each end thereof with steps 33 formed integrally with the end walls 32 of the modules 27, 27*a* and 28, 28*a*; an outer guard rail means 60 extended continuously about the outer side of the walkway 17; and an inner guard rail means 65 extended along only the inner side of the longitudinal section 18 of the walkway 17.

The machinery housing 24 has an open side (not shown) positioned against the walkway end section 21 (FIGS. 1 and 11) so that the end section 21 and the top surface 66 of the housing 24 form a continuous horizontal platform at the top of the steps 26. Hand rails 67 for the steps 26 are connected to the outer side of the walkway end section 21 and to the lowermost one of the steps 26.

The space below the longitudinal section 18 and end section 19 of the walkway 17 is closed by cover plates 68. Each cover plate 68 (FIG. 10) is of a fiberglass construction and of a generally rectangular shape formed with a continuous laterally extended marginal flange 71. A cover plate 68 has secured to that portion of the marginal flange 71 thereof located at its upper side, the horizontal leg 72 of an angle member 73, the vertical leg 74 of which has one side in a plane common to the outer surface of the cover plate 68. The angle member 73 is located within the U-shape portion 45 at the outer side of the walkway 17 with the vertical leg 74 positioned against the inner surface of the outer leg 69 of such U-shape portion to which it is secured by bolt assemblies 76.

The combination pool cover and splash board assembly 22 is comprised of separate section 77 (FIG. 1) that are arranged in an end to end relation longitudinally of the pool. The adjacent ends of these sections 77 are relatively constructed for overlapping engagement when the assembly 22 is in either the open or closed positions therefor. Each cover section 77 (FIG. 3) is pivotally connected by a plurality of hinge units 78 (only one of which is shown). Each hinge unit 78 includes a first hinge plate 79 of a generally J-shape in longitudinal cross section secured to a cover section 77 so that the short leg 81 thereof extends downwardly along one side of a section 77. A second hinge plate 82 of a generally right angle shape in longitudinal cross section, has a horizontal leg pivotally connected at 83 to the short leg 81 of the hinge plate 79 and a vertical leg 84 secured to the upright marginal flange 71 at the tank side wall 23.

When the cover and splash board assembly 22 is in a tank covering position, as shown in FIG. 3, a section 77 extends horizontally of the tank sidewalls 13 and 23 with the free end 86 thereof supported on a horizontal shelf member 87 that interconnects the upright marginal flange 71 and tank side wall 23. As illustrated in dotted lines in FIG. 3, an open position of a cover section 77 is defined by the engagement of the short leg 81 of the hinge plate 79 with the horizontal leg of the hinge plate 82. In its open position the combination cover and splash board assembly 22 is extended upwardly and outwardly from the pool side wall 23 with the lower end thereof located inwardly of the marginal flange 71.

Figure 14:
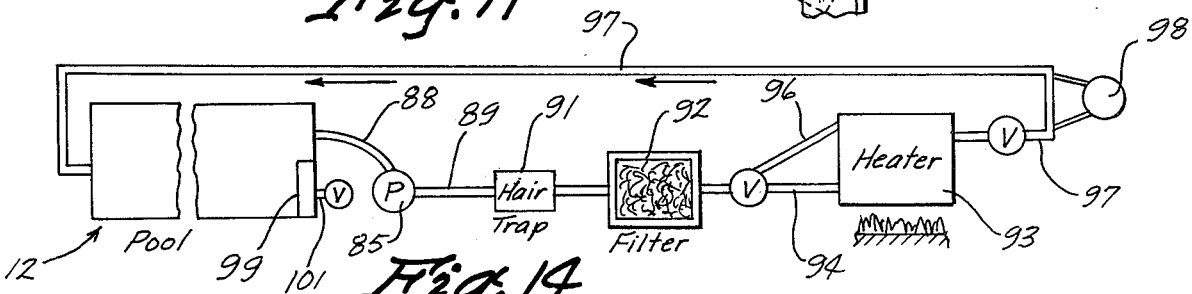
FIG. 14 is a schematic showing of the water circulating system for the pool.

For use in the teaching of children of elementary school age the tank 12 is filled from a suitable source of water (not shown) to a level or height that is substantially knee deep on a child standing on the bottom of the tank or pool. The water is continuously circulated within the pool (FIGS. 2 and 14) by a pump unit 85 having an inlet 88 open to the inside of the pool 12 at a hole 88 (FIG. 1) formed in the back of one of the steps 33 in the end wall 32 in the right hand module 27. Water from the pump outlet 89 (FIGS. 2 and 14) passes successively through a hair trap 91 and a filter 92. From the filter 92 a portion of the water is directed through a heater 93 through a heater inlet pipe 94 while a second portion of the water from the filter bypasses the heater through pipe 96. The bypassed water and the heated water are then brought together into a single pipe 97. A chlorinator unit 98 is shunted across a portion of the pipe 97 for chemically treating the water prior to its admission into the pool 12 from the line 97 through an opening 90 formed in the back member of a step 33 of the left hand module 28*a*. In use the pool water is maintained at a temperature of from about 85° to 90° F and continuously circulated over the complete area of the pool.

As best appears in FIG. 2, the pump 85, hairtrap 91, filter 92, heater 93 and chlorinator 98 are all carried within the machinery housing 24 so as to be readily accessible for maintenance and service purposes by merely separating such housing from the remainder of the pool assembly.

For draining the pool the only left hand module 28 (FIGS. 2 and 13) is formed in its bottom wall 29 at a position adjacent the lowermost one of the steps 33 with a transversely extended recess or trough 99 provided with a valve controlled drain opening 101. The trough 99 is longitudinally inclined to the drain opening 101.

In using the pool 12 for teaching purposes, children, in number corresponding to the training stations or marked areas 43, are admitted to the pool by use of the steps 26. When in the pool they are assigned to a training station or marked area 43 and for elementary students of an age corresponding to third graders and downwardly, their confinement within a training station 43 is strongly insisted upon. This procedure completely eliminates the grouping of the children into parts, bunches or groups which would, of course, prevent adequate body movement for instructional swimming.

To prevent any embarassment to a child as a result of having his name called too frequently during instruction periods, each child is assigned and then addressed by the number of his training station. With a child in his assigned training station 43, he is first instructed to kneel in the pool and then assume a position with his hands and knees on the pool bottom. In this position he is acclimated to the water by first dipping his face therein and then later by dipping his face and concurrently blowing bubbles. This exercise is then followed by having a child hold his breath and submerging his head for short counts varied at the discretion of the instructor.

When the greater portion, usually about 90 percent of the instructional class, exhibits a free and full acclimation to the water, the children are instructed to hold their bodies horizontally with their hands in finger touching engagement with the bottom of the pool. This exercise is first practiced with the head lifted upwardly out of the water after which the hands are withdrawn from the pool bottom with the head in a full float position. Again when about a 90 percent portion of the class is capable of performing a full face float, the class is instructed to return to the horizontal body position with the hands in finger touching engagement with the pool bottom, and with faces uplifted are taught stiff leg kicking movements.

When these leg kicking movements are learned, the children are permitted to finger tip along the pool bottom, with faces exposed, up one row of the training stations 43 and down the other row thereof, while utilizing the kicking movements they have learned. During this travel up and down the pool 12, the children are encouraged to cup their hands as often as possible without touching the pool bottom to help them acquire a dog paddle arm movement.

Again, when about 90 percent of the class is able to dog paddle around the pool, over-arm swimming movements are taught while the children are standing on the pool bottom in their assigned training stations. On learning the over-arm swimming movements in a standing position, the children are permitted to combine such arm movements with the previously learned leg movements for swimming up and down the pool. In this connection, it will be appreciated that the swimming instructions are repetitive and progressive so that a more advanced exercise is undertaken only after prior lessons have been learned. The exercises are thus acquired at a leisurely pace so that the swimming actions follow in a natural and orderly procedure.

By virtue of the relatively small water expanse in the pool and the fact that the bottom of the pool is always in touching engagement with either the feet or finger tips, fear of the water is completely eliminated so as to provide full attention to the swimming instructions.

In one embodiment of the invention the tank 12 is about 36 feet long and 5½ feet wide, with an over-all height of about 38 inches. Each module 27, 27*a* and 28 and 28*a* is about 33 inches wide and 18 feet long with a bottom wall length of about 15 feet. The walkway 17 is about 2 feet wide, with a side plate member having a length of about 9 feet.

Figure 6:
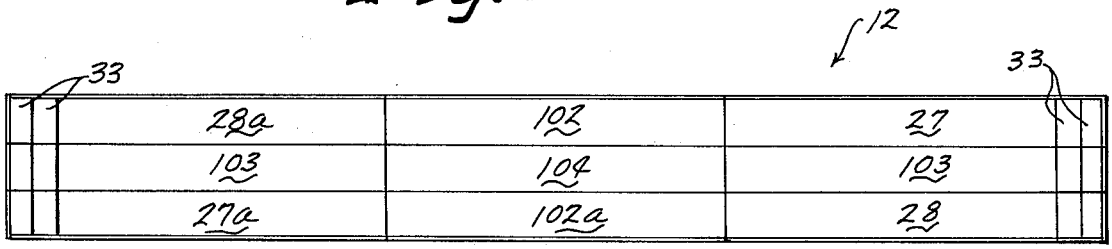
FIG. 6 is illustrated similar to FIG. 4 and shows the pool of FIG. 4 enlarged by module additions thereto.
Figure 7:
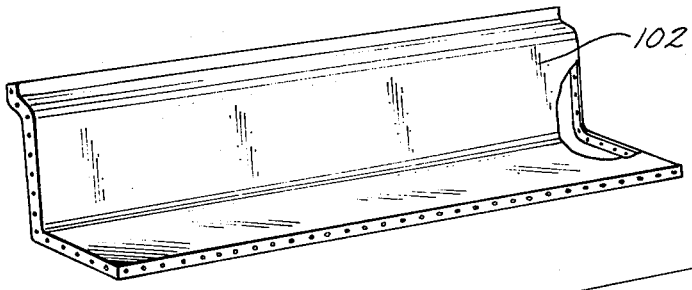
FIGS. 7, 8 and 9 are perspective views of module sections for enlarging the pool shown in FIG. 4 to the pool size shown in FIG. 6.
Figure 8:
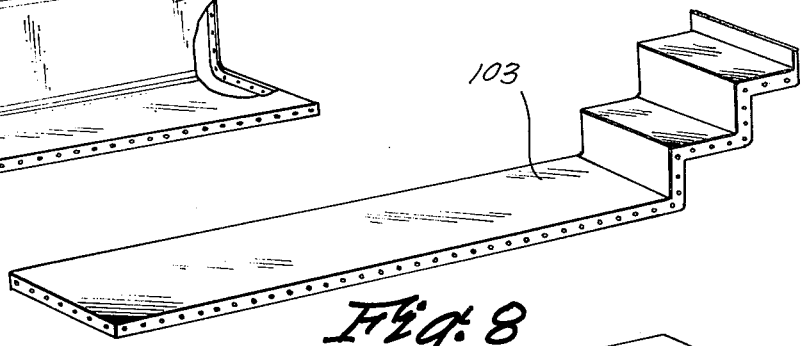
Figure 9:
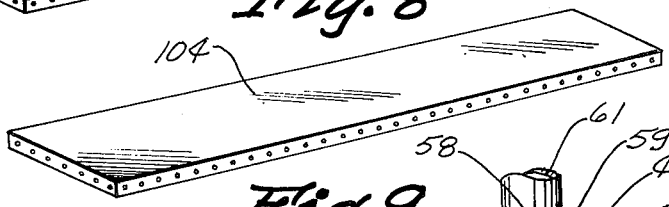

If it is desired to lengthen the pool, a module section 102 (FIG. 7) and a mirror image thereof, indicated at 102*a* in FIG. 6, are connectible between longitudinally opposite ones of the left and right hand modules 28, 28*a* and 27 and 27*a*, respectively. If the pool 12 is to be widened, such is accomplished by the insertion of a module 103 between transversely opposite ones of the module 27, 27*a*, and 28, 28*a* (FIGS. 6 and 8). If it is desired to concurrently lengthen and widen the pool 12, the modules 102, 102*2* and 103 are used concurrently with a module 104, shown in FIG. 9, which consists entirely of only a bottom wall. It will be appreciated that the modules 104 will be arranged between transversely opposite ones of sections 102 and 102*a* so as to constitute floor extensions for the bottom wall portions of the modules 103.

In the above embodiment of the pool 12, the modules 102 and 102*a* are about 15 feet long and 33 inches wide; the module 103 about 18 feet long and 33 inches wide with a bottom wall length of 15 feet; and a module 104 is 15 feet long and 33 inches wide.

Although the invention has been described with respect to a preferred embodiment thereof, it is to be understood that it is not to be so limited and that changes and modifications can be made therein which are within the full intended scope of this invention as defined by the appended claims.

I claim:

1. A learning pool for child swimmers comprising:

a. an elongated tank of a substantially U-shape in transverse cross section integrally formed with a bottom wall, side walls and end walls, b. a continuous horizontal walkway extended laterally outwardly from the upper edge of said end walls and from one of said side walls, c. each of said end walls comprised of a series of step members leading from said walkway to said bottom wall, d. a combination cover and splash board assembly for said tank, e. means pivotally connecting said combination assembly at one side thereof to the upper end of the other one of said tank side walls for pivotal movement to a first position extended upwardly and outwardly from said other tank side wall, and to a second horizontal position extended across said tank between the side walls thereof, f. coacting means on said combination assembly and tank for limiting the pivotal movement of said combination assembly to said first position therefor, and g. means on said tank one side wall engageable with the opposite side of said combination assembly to define said second position therefor.

* * * * *